US011255034B2

(12) United States Patent
Lee et al.

(10) Patent No.: US 11,255,034 B2
(45) Date of Patent: Feb. 22, 2022

(54) METHOD, DEVICE, AND SYSTEM FOR DETECTING DYNAMIC IMBALANCE OF WASHING MACHINE

(71) Applicant: LG ELECTRONICS INC., Seoul (KR)

(72) Inventors: Ju Hyoung Lee, Seoul (KR); Bon Kwon Koo, Seoul (KR); Sang Hyun Lee, Seoul (KR); Hyun Ji Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 124 days.

(21) Appl. No.: 16/561,924

(22) Filed: Sep. 5, 2019

(65) Prior Publication Data

US 2019/0390389 A1 Dec. 26, 2019

(30) Foreign Application Priority Data

Jun. 21, 2019 (KR) ..... 10-2019-0074315

(51) Int. Cl.
*D06F 37/20* (2006.01)
*D06F 33/02* (2006.01)
(Continued)

(52) U.S. Cl.
CPC ..... *D06F 33/48* (2020.02); *D06F 34/16* (2020.02); *D06F 33/76* (2020.02); *D06F 34/05* (2020.02);
(Continued)

(58) Field of Classification Search
CPC .... D06F 37/203; D06F 33/00; D06F 2216/00; D06F 2204/10; D06F 2222/00;
(Continued)

(56) References Cited

U.S. PATENT DOCUMENTS

2002/0194682 A1* 12/2002 Conrath ..... D06F 33/48 8/159
2007/0039104 A1* 2/2007 Lee ..... D06F 37/203 8/158

(Continued)

FOREIGN PATENT DOCUMENTS

KR 10-2007-0021786 A 2/2007
KR 10-2013-0070808 A 6/2013
KR 101841248 B1 * 3/2018

*Primary Examiner* — Benjamin L Osterhout
*Assistant Examiner* — Pallavi Chitta
(74) *Attorney, Agent, or Firm* — Birch, Stewart, Kolasch & Birch, LLP

(57) ABSTRACT

A dynamic imbalance detection system capable of whether a washing machine is in a dynamically imbalanced position by using big data and executing an AI algorithm or a machine learning algorithm in a 5G communications network environment built for IoT. The system includes a washing machine and a server communicating with the washing machine. The washing machine includes a vibration sensor attached to a washing machine cabinet and a controller receiving a vibration signal detected by the vibration sensor during the operation of the washing machine and processing the vibration signal into vibration data. The server receives the vibration data from the controller and trains a machine learning algorithm on a training dataset that is obtained by processing one or more features among a displacement magnitude, a displacement ratio, and a displacement phase, and determines result values of dynamic balance and dynamic imbalance labeled with the one or more features.

7 Claims, 15 Drawing Sheets

(51) Int. Cl.

| | |
|---|---|
| ***D06F 33/48*** | (2020.01) |
| ***D06F 34/16*** | (2020.01) |
| *D06F 103/26* | (2020.01) |
| *D06F 105/58* | (2020.01) |
| *D06F 33/76* | (2020.01) |
| *D06F 34/05* | (2020.01) |
| *D06F 34/32* | (2020.01) |
| *D06F 101/00* | (2020.01) |
| *D06F 39/12* | (2006.01) |

(52) U.S. Cl.
CPC ..... *D06F 34/32* (2020.02); *D06F 39/125* (2013.01); *D06F 2101/00* (2020.02); *D06F 2103/26* (2020.02); *D06F 2105/58* (2020.02)

(58) Field of Classification Search
CPC .. D06F 2202/06; D06F 34/32; D06F 2101/00; D06F 39/125; D06F 34/16; D06F 33/76; D06F 34/05; D06F 2105/58; D06F 2103/26; D06F 33/48
See application file for complete search history.

(56) References Cited

U.S. PATENT DOCUMENTS

2013/0118210 A1* 5/2013 Wee ..... D06F 33/48 68/12.06
2013/0197709 A1* 8/2013 Grimminger ..... G05B 19/0426 700/295

* cited by examiner

[FIG. 1]
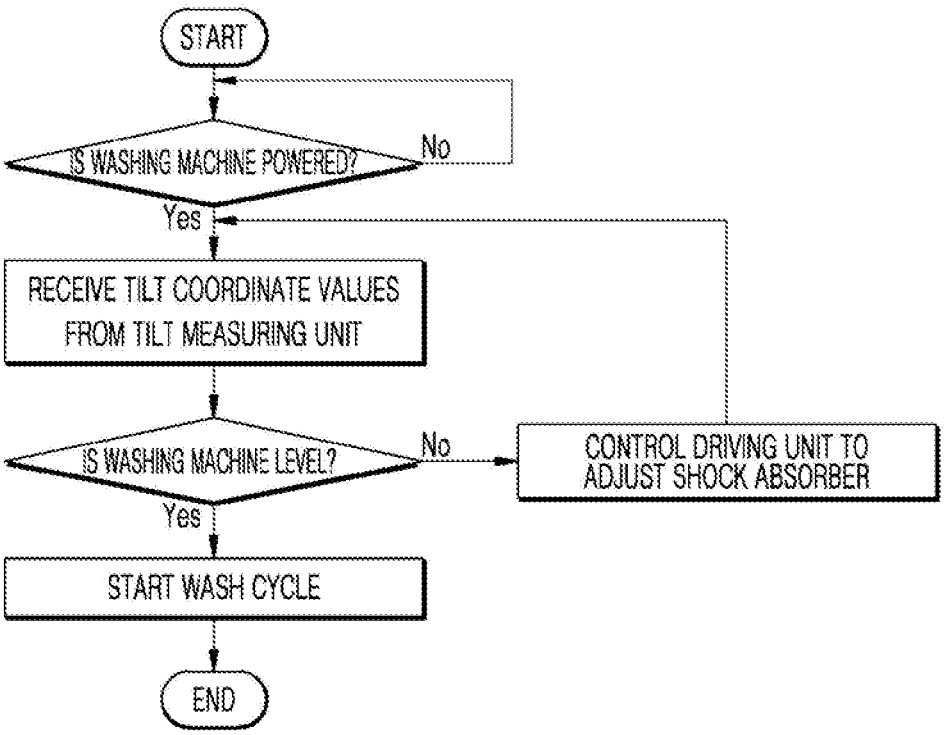

[FIG.2]
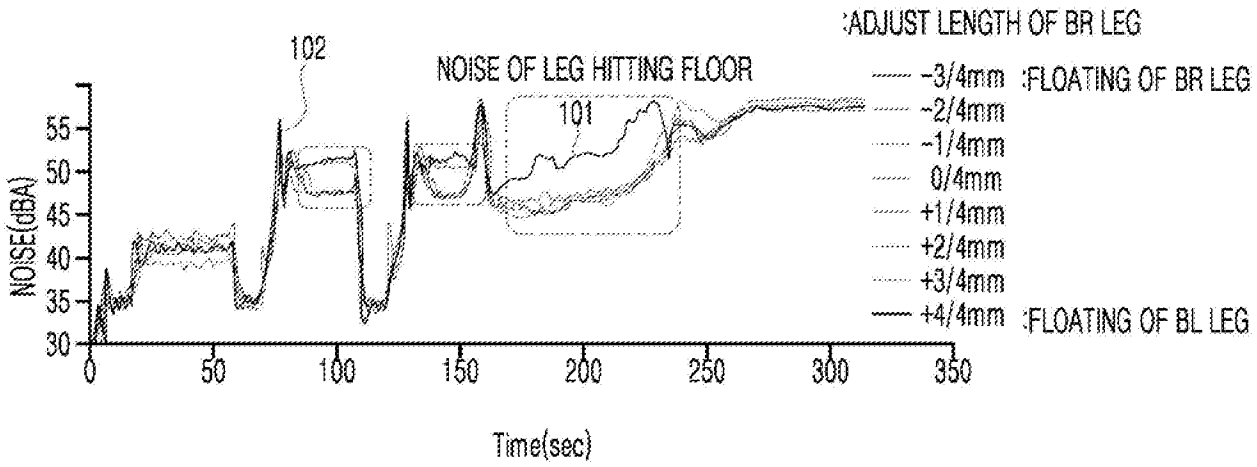

[FIG. 3]
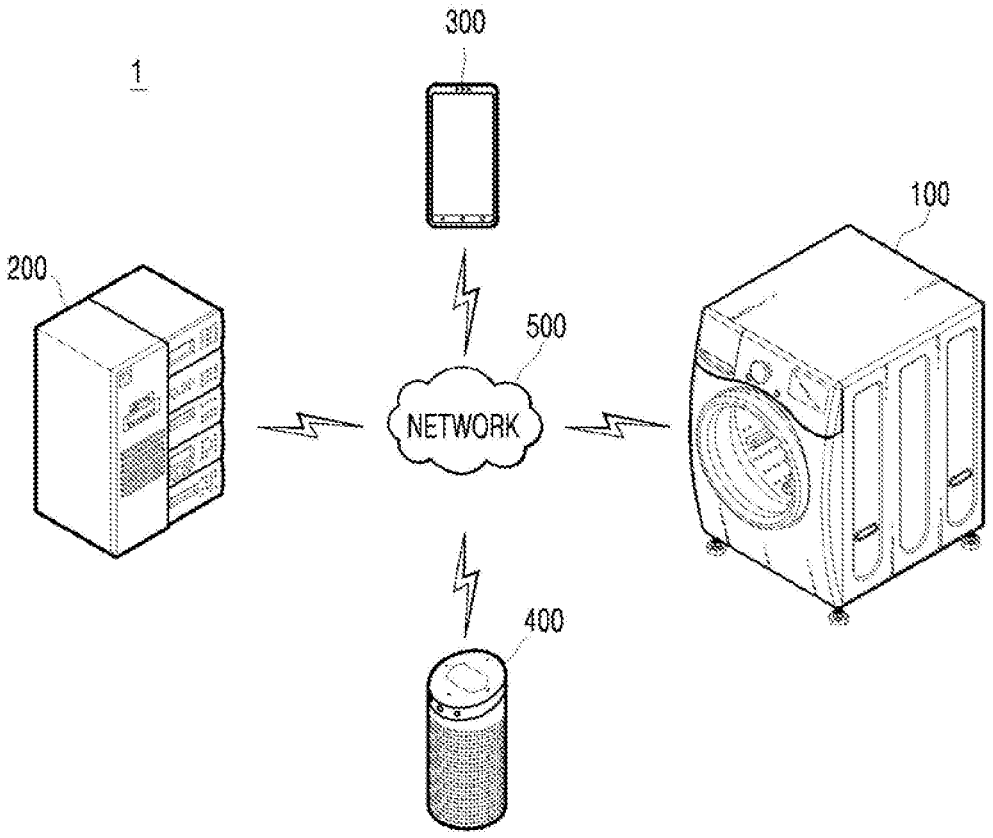

[FIG. 4]
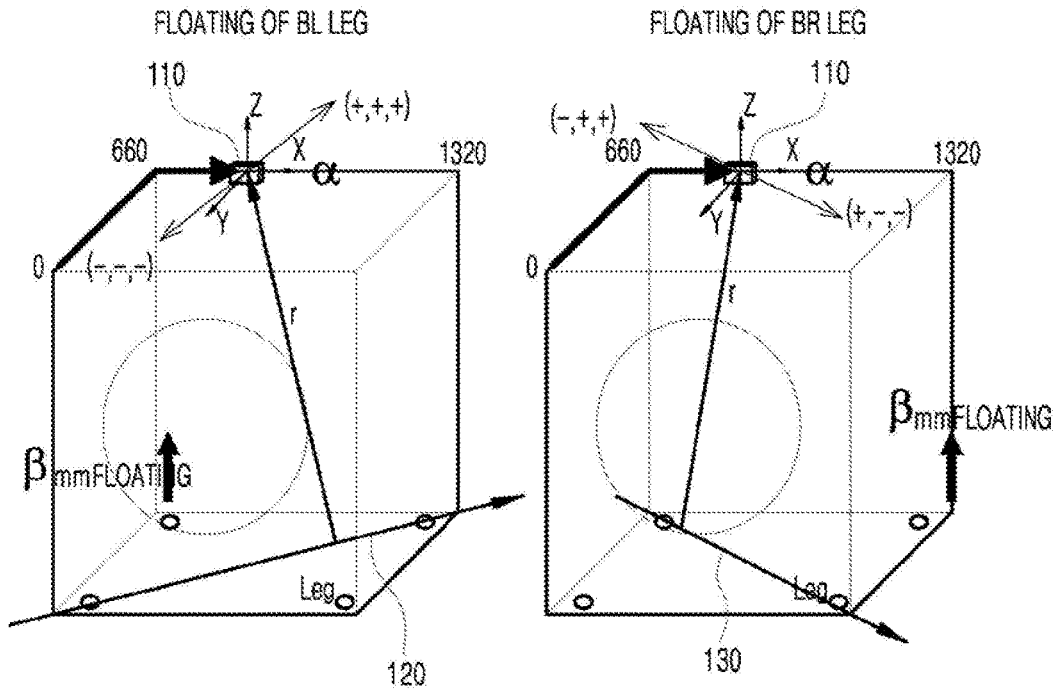
[FIG. 5a]
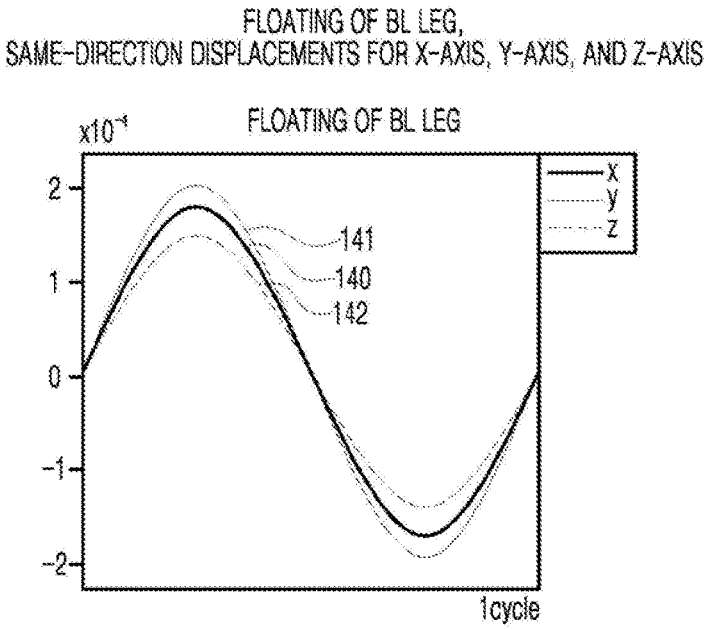

[FIG. 5b]
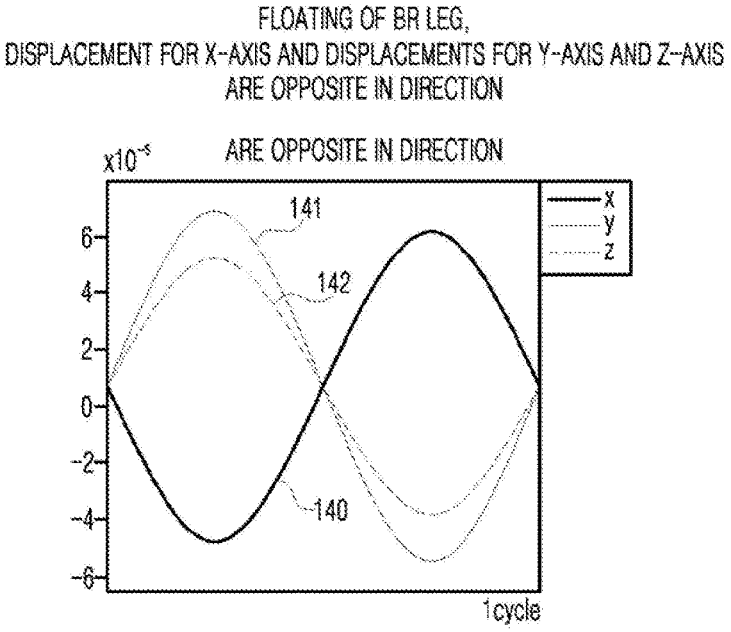
[FIG. 6]
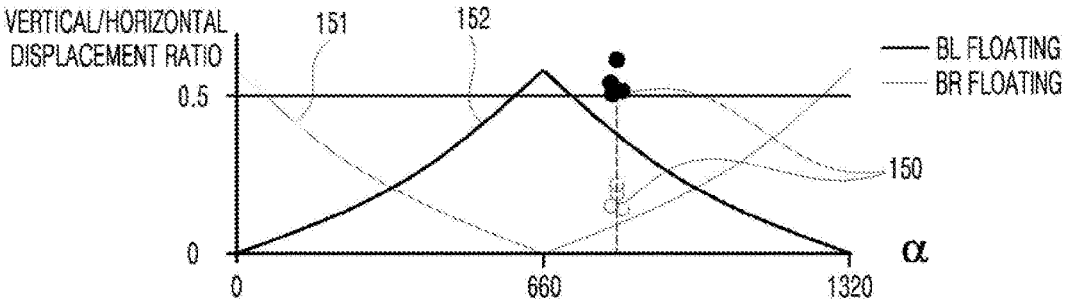

[FIG. 7]
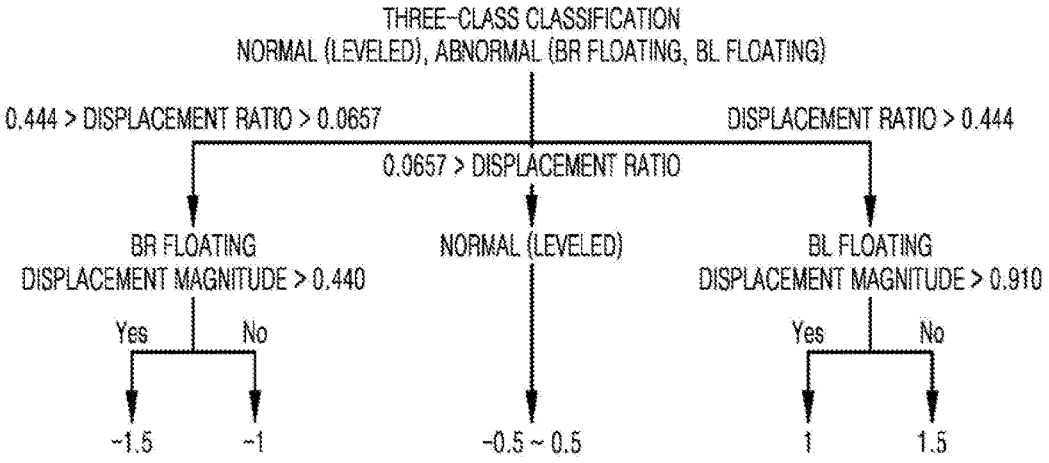
[FIG. 8]
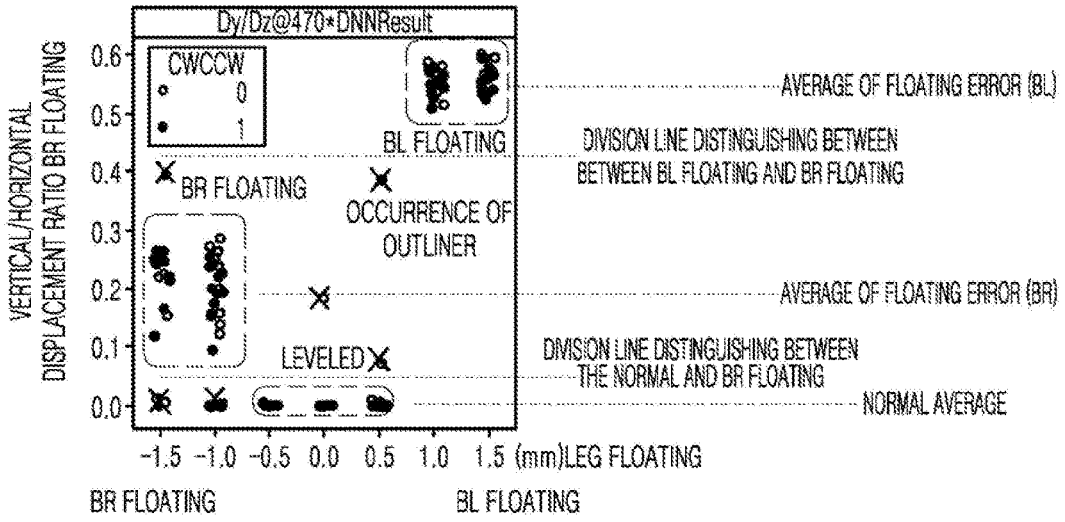

[FIG. 9]
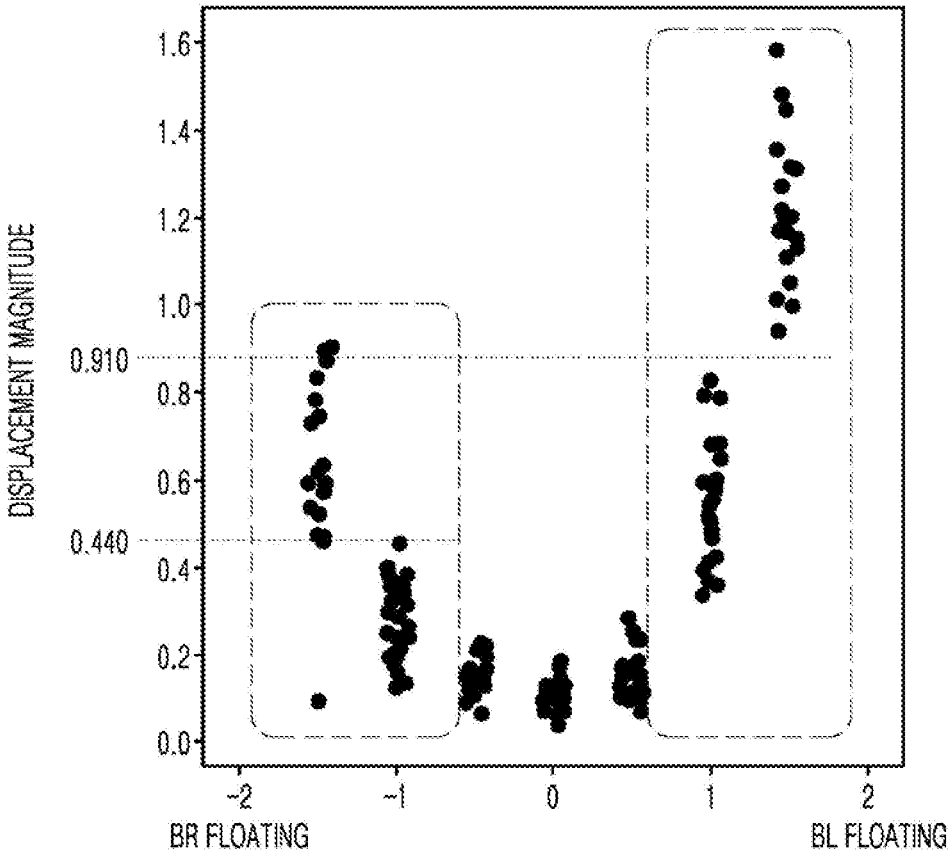

[FIG. 10]
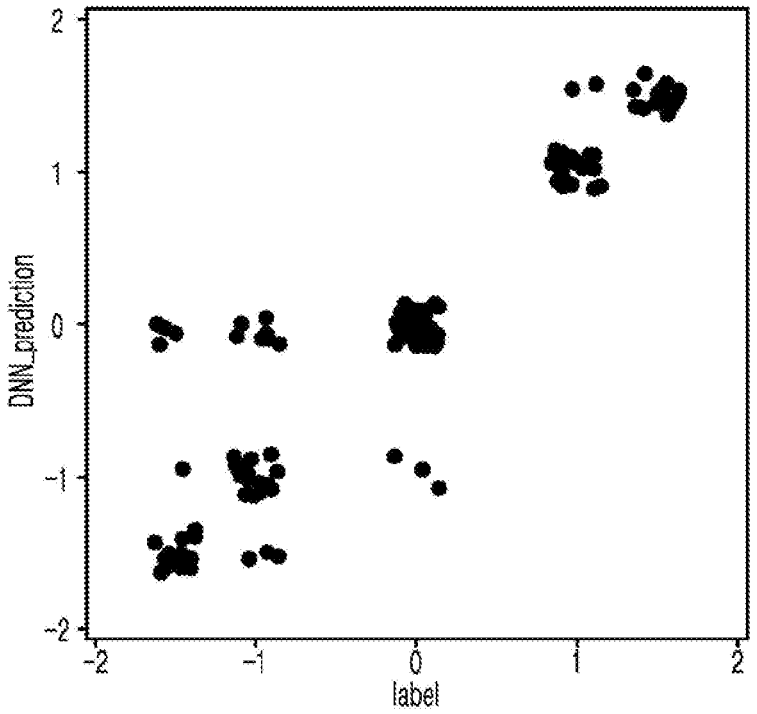

[FIG. 11]
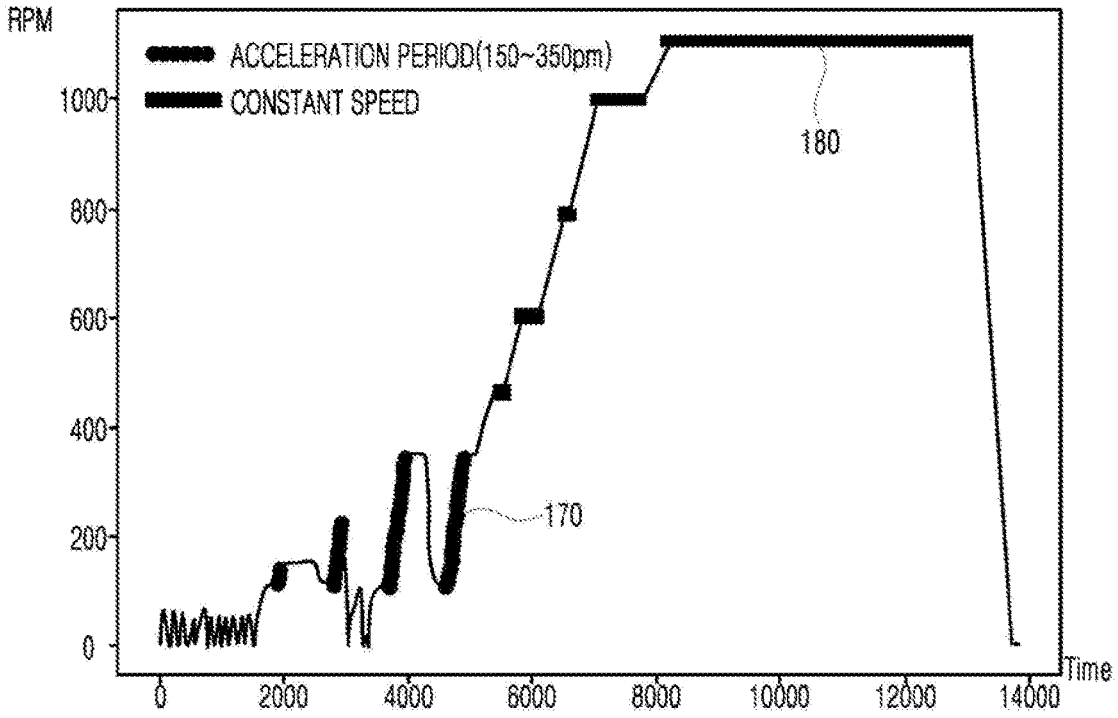

[FIG. 12]
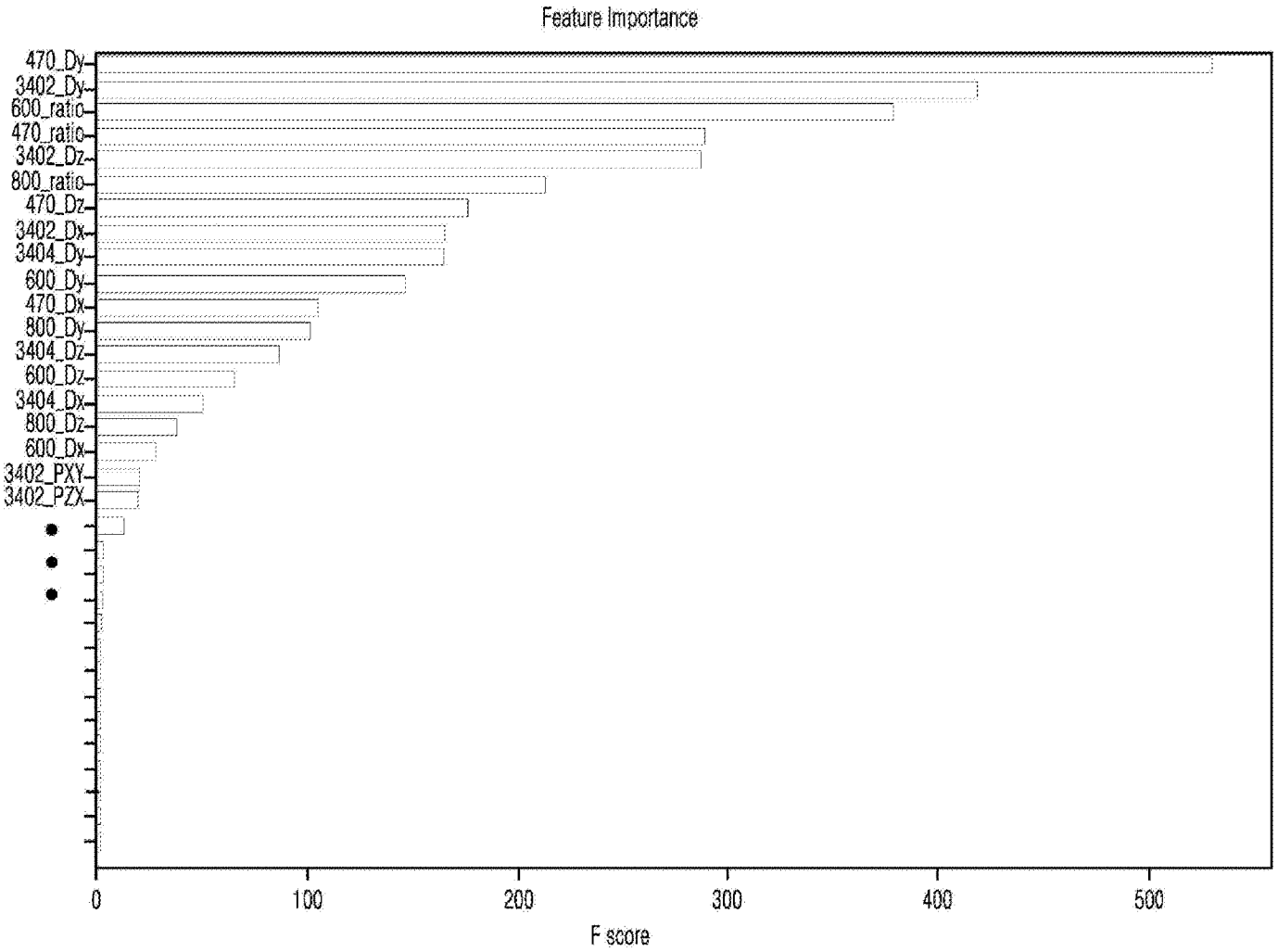

[FIG. 13]
TRAINING RESULT
| ACCURACY | 0.95 |
|---|---|
| TRAINING GRAPH | 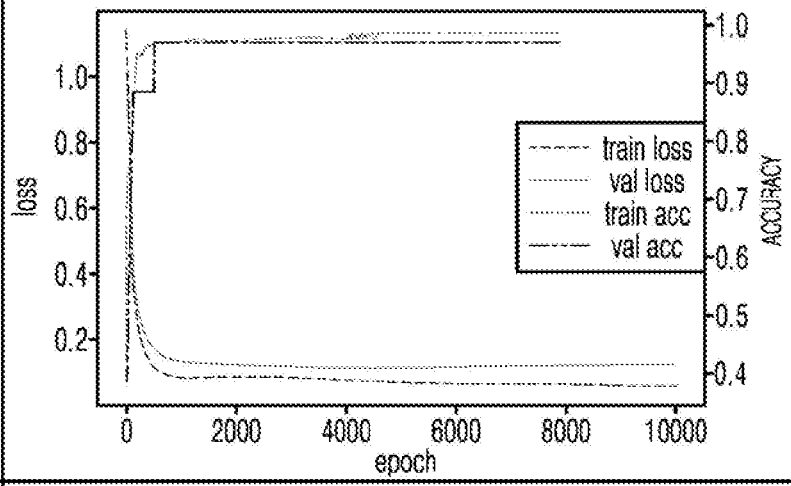 |
| Layer | 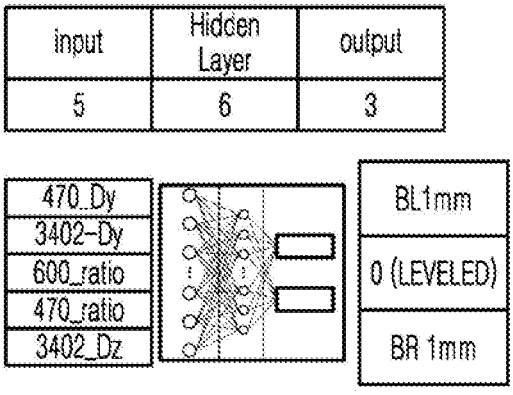 |

[FIG. 14]
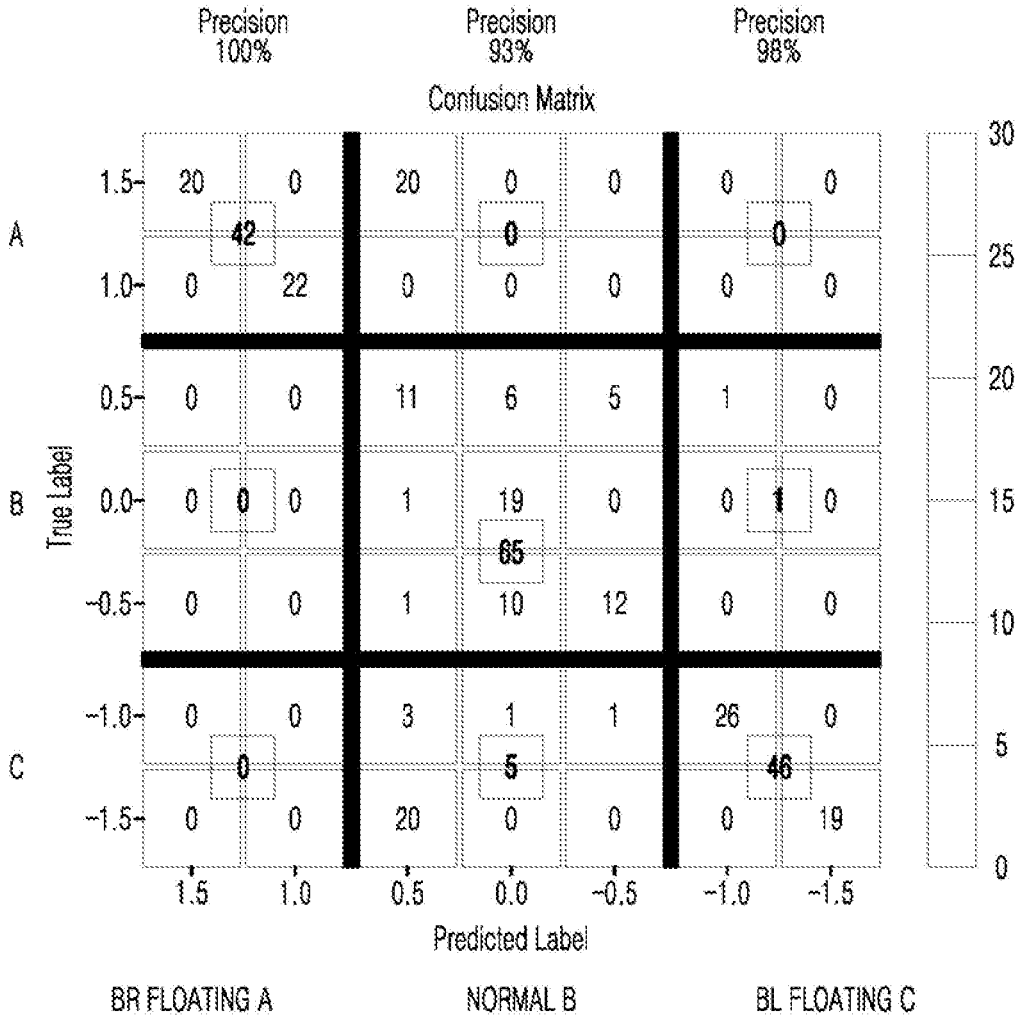

[FIG. 15]
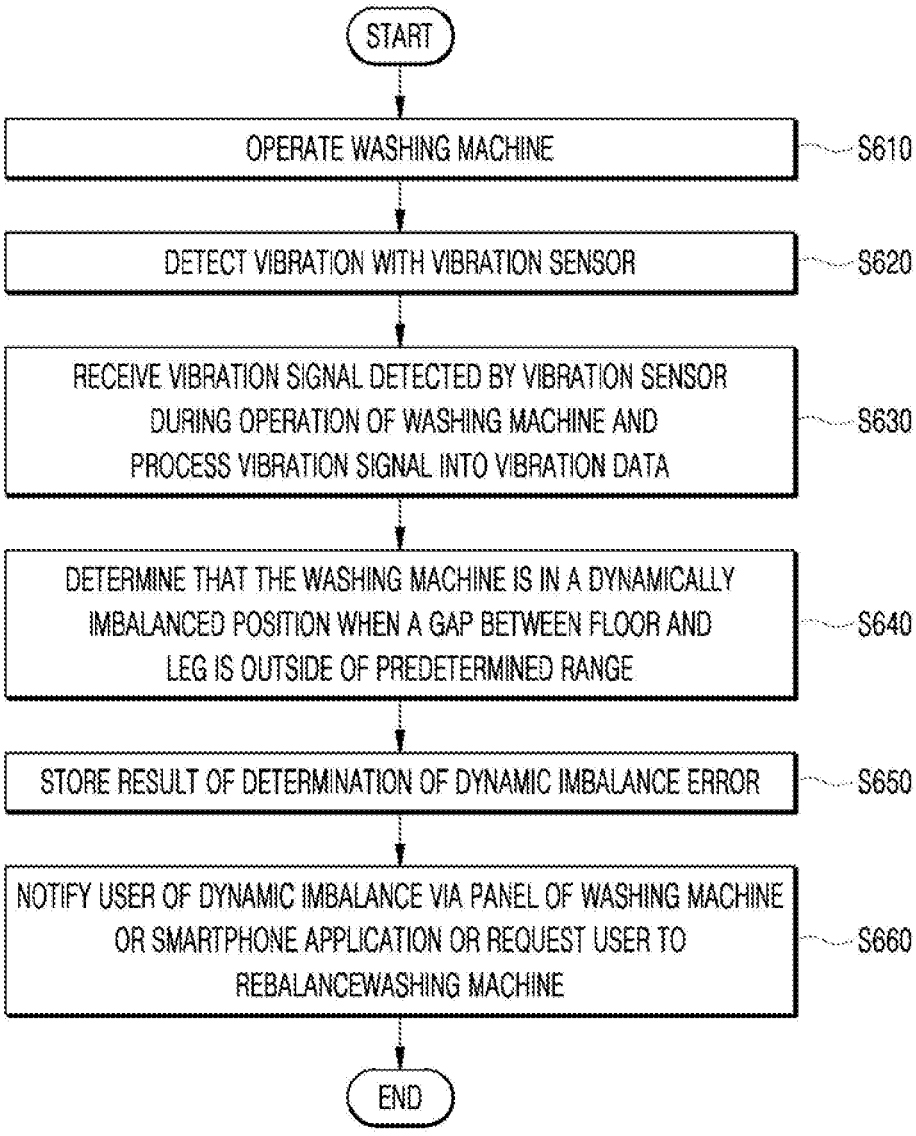

[FIG. 16]
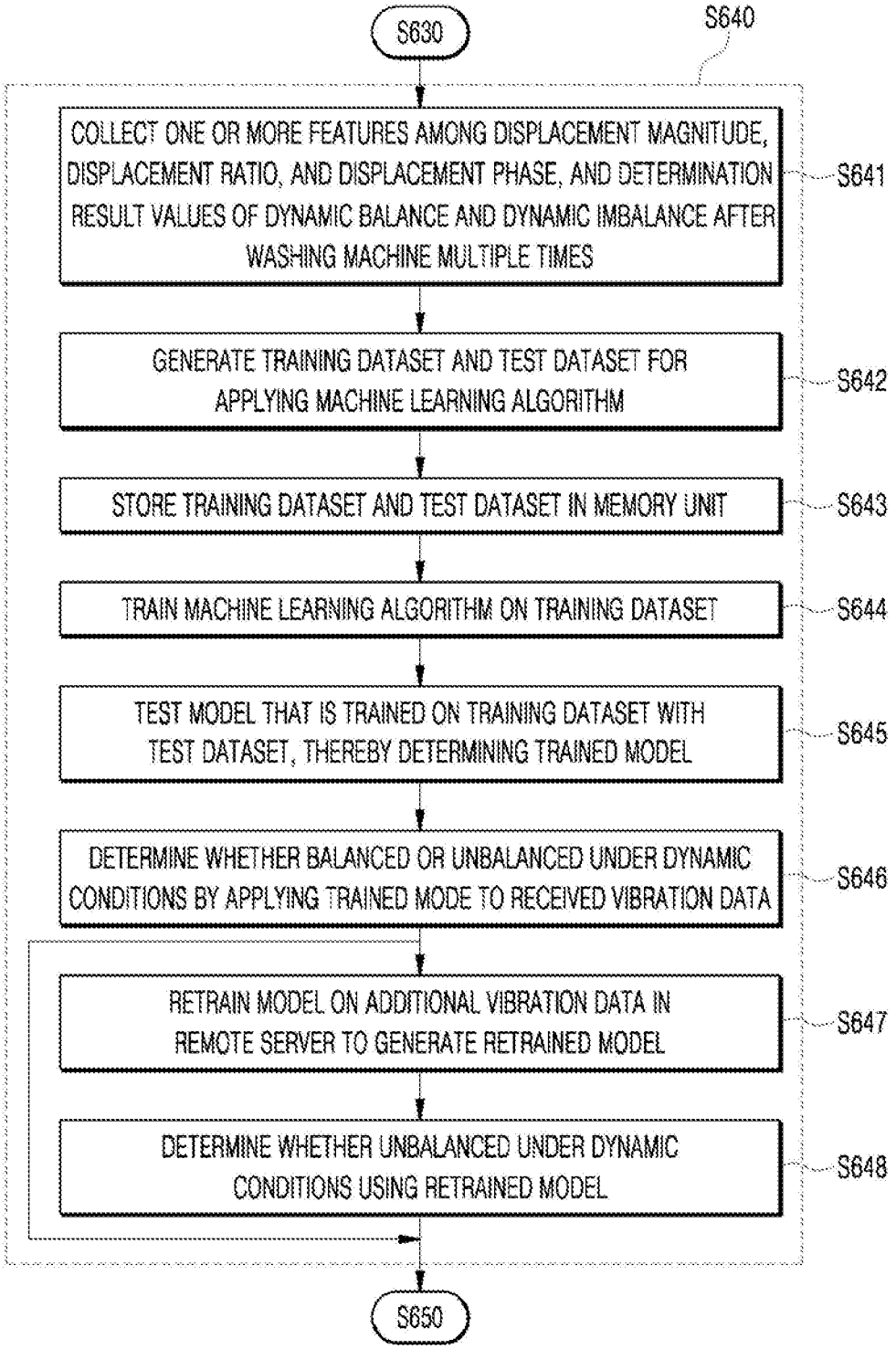

[FIG. 17]
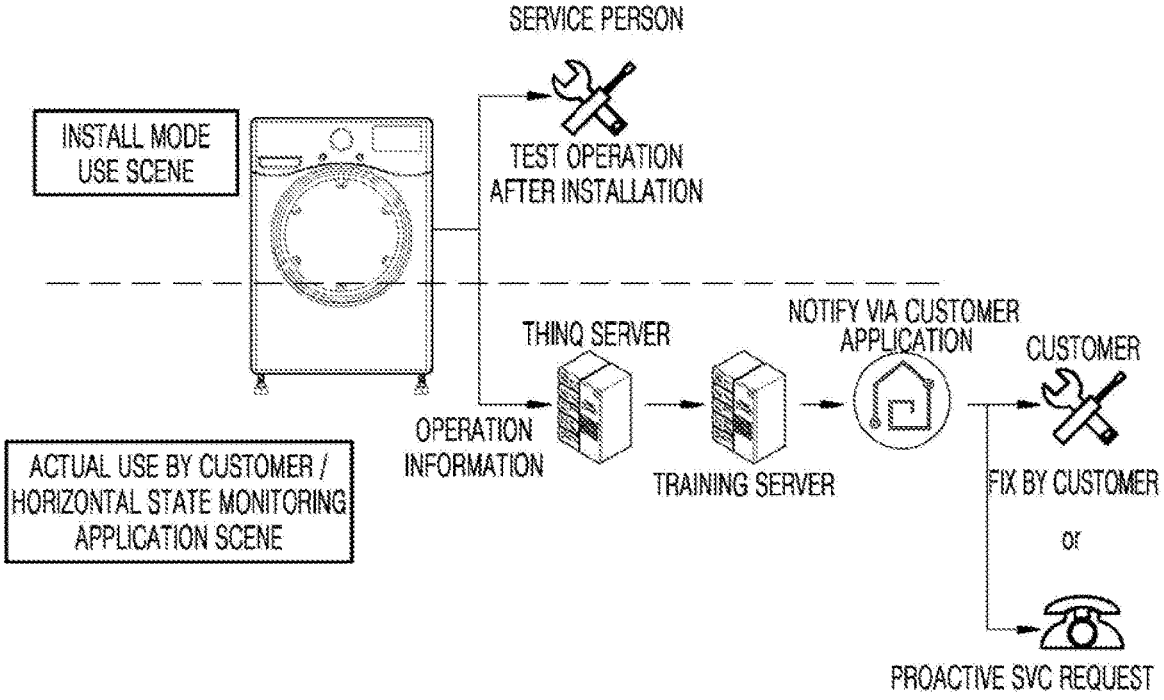

METHOD, DEVICE, AND SYSTEM FOR DETECTING DYNAMIC IMBALANCE OF WASHING MACHINE

CROSS-REFERENCE TO RELATED APPLICATION

The present application claims benefit of priority to Korean Patent Application No. 10-2019-0074315), entitled "METHOD, DEVICE, AND SYSTEM FOR DETECTING DYNAMIC UNBALANCE OF WASHING MACHINE," filed on Jun. 21, 2019 in the Korean Intellectual Property Office, the entirety of which is incorporated by reference herein.

BACKGROUND OF THE DISCLOSURE

1. Field of the Invention

The present disclosure relates to a method, device, and system for detecting, using a vibration sensor, dynamic imbalance of a washing machine, dryer, or any apparatus where imbalance is likely to occur due to the rotation of a motor. More specifically, the present disclosure relates to a vibration detection system or a device that detects dynamic imbalance of a washing machine when a dynamically balanced position at which the washing machine is balanced under dynamic conditions continuously changes due to vibration (hereinafter, referred to as cabinet vibration) of a washing machine cabinet and swirling of laundry in a washing machine drum during the operation of the washing machine.

2. Description of Related Art

A washing machine needs to be level on the floor to function properly. When first installing a washing machine, the washing machine is placed on a flat surface and its height is then adjusted such that the washing machine is level. There are two types of washing machines. One type is a horizontal type in which a drum is positioned perpendicular to the direction of gravity when a washing machine is stationary. This state is referred to as a statically balanced position or as balanced under static conditions.

In the related art, an example of washing machine discloses a washing machine leveling apparatus and method. The washing machine leveling apparatus includes a tilt measuring unit that measures the tilt of a washing machine with respect to the floor surface using at least one sensor selected from a group of an accelerometer, a gravity sensor, and a gyroscope and a height adjusting unit that adjusts the height of the washing machine. The leveling apparatus determines whether the washing machine is level based on the tilt measured by the tilt measuring unit.

FIG. 1 is a flowchart of a method of detecting and correcting an imbalance of a washing machine under static conditions, disclosed in Related Art 1. The conventional washing machine measures its tilt (inclination) with respect to the floor surface using a vibration sensor and, when the tilt is not within allowable limits, self-levels using its height adjusting mechanism. When the washing machine is powered, a controller receives coordinate values from the tilt measuring unit and determines whether the washing machine is balanced under static conditions (in a statically balanced position) based on the coordinate values. Specifically, the controller determines whether the washing machine is in a statically balanced position by checking whether the coordinate values are within a preset range.

Other example of washing machine discloses a method and device for determining whether a washing machine is in a statically balanced position using a multi-axis accelerometer that detects changes in acceleration for two or more axes of the washing machine. The device includes: a multi-axis accelerometer that detects a tilt with respect to each of two or more axes of the washing machine and outputs a tilt information signal for each axis; and a microcomputer that receives the tilt information signals, calculates the levelness of the washing machine, and outputs a levelness information signal.

The technologies in related art determine whether a washing machine is balanced or unbalanced under static conditions but does not determine whether a washing machine is balanced or unbalanced under dynamic conditions (during the operation of the washing machine).

FIG. 2 is a graph illustrating an increase in dehydration noise attributable to the dynamic imbalance of a washing machine. The term "dynamically balanced position" refers to a position, in which a washing machine is balanced under dynamic conditions (during operation), of a washing machine. Typical washing machines have four legs. However, since three points are enough to define a plane, a washing machine can stand on the floor on three legs. Therefore, there is likely to be a case where a washing machine stands on three legs resting on the floor and with one leg floating. In this case, no problems occur when the washing machine is not in operation. However, when the washing machine starts operating, the washing machine vibrates. In this case, the legs that contact the floor continuously change, which changes a level position in which the washing machine is balanced and generates noise by repeatedly hitting the floor. During the operation of a washing machine, a level position at which the legs of the washing machine are level moves. For this reason, a level position at which the washing machine is balanced during the operation of a washing machine is called a dynamically balanced position.

Herein, the term "dynamically balanced position" refers to a state or position in which all four legs of a washing machine are in contact with the floor surface during the operation of a washing machine. Although a washing machine is perfectly leveled such that all four legs are in contact with the floor when the washing machine is not in operation, some of the legs of the washing machine are likely to rise off the floor due to the eccentric rotation of laundry during the operation of the washing machine. When the dynamic balance fails, some of the legs will hit the floor, generating noise as illustrated in FIG. 2. In addition, the center of gravity of the washing machine becomes unstable, easily resulting in the washing machine walking.

As described above, dynamic balance is a significantly influencing factor on noise and vibration. However, the existing imbalance detection methods focus on static leveling but do not deal with dynamic balance.

SUMMARY OF THE INVENTION

The present disclosure has been made in view of the problems occurring in the related art, and an object of the present disclosure is to provide a solution of detecting a dynamically balanced position as well as a statically balanced position of a washing machine.

Specifically, the present disclosure is intended to provide a method of detecting dynamic imbalance of a washing machine using a vibration sensor attached to a washing machine cabinet during the operation of the washing machine.

Another object of the present disclosure is to provide a method of correctly estimating a gap size between the floor and the leg of a washing machine using a machine learning algorithm and cabinet vibration data recorded in a washing machine or a server.

Technical problems to be solved by the present disclosure are not limited to the technical problems mentioned above, and other technical problems that are not mentioned above also can be clearly understood by those skilled in the art to which the present disclosure belongs.

In order to accomplish the above or other objects, according to one aspect of the present disclosure, there are provided a method and system for detecting dynamic imbalance of a washing machine, the system including: a washing machine equipped with a vibration sensor and a controller that processes a vibration signal transmitted from the vibration sensor; and a server configured to communicate with the washing machine.

According to one embodiment of the present disclosure, there are provided a washing system and a dynamic imbalance detection method, the system and method including: a starting operation module of a washing machine; a vibration detection module using a vibration sensor attached to a washing machine cabinet at a position spaced, by a predetermined distance, from a specific vibration axis that connects two legs in contact with the floor during the operation of the washing machine; a module of causing a controller to receive a vibration signal transmitted from the vibration sensor during the operation of the washing machine and process the vibration signal into vibration data; and a module of causing the controller or a server receiving the vibration data from the controller to determine that the washing machine is in a dynamically imbalanced position when a gap between the floor and a leg that is floating is outside a predetermined range when two legs other than the two legs forming the vibration axis and contact the floor vibrate to alternatively float and contact the floor.

According to a further embodiment of the present disclosure, the washing machine may include: a vibration sensor attached to a washing machine cabinet at a position spaced by a predetermined distance from a vibration axis that connects two legs among legs in contact with the floor during the operation of the washing machine; and a controller for processing a vibration signal transmitted from the vibration sensor into vibration data during the operation of the washing machine.

The effects, features, and objects of the present disclosure are not limited to the ones mentioned above, and other effects, features, and objects not mentioned above can be clearly understood by those skilled in the art from the following description.

BRIEF DESCRIPTION OF THE DRAWINGS

FIG. 1 is a flowchart illustrating a method of detecting a static imbalance of a washing machine and a method of properly balancing the washing machine, according to a related art.

FIG. 2 is a graph illustrating an increase in dehydration noise attributable to a dynamic imbalance of a washing machine.

FIG. 3 is diagram illustrating an example of an operating environment for a dynamic imbalance detection system including a washing machine of a laundry system, a user terminal, an output device, and a network that connects the washing machine, the user terminal, and the output device, according to one embodiment of the present disclosure.

FIG. 4 is a diagram illustrating the magnitude and direction of vibration when a washing machine is in a dynamically imbalanced position, according to embodiment of the present disclosure.

FIG. 5A is a diagram illustrating an example of a pattern of axial vibrations of the back left leg that is floating when a washing machine is in a dynamically imbalanced position, according to one embodiment of the present disclosure.

FIG. 5B is a diagram illustrating an example of a pattern of axial vibrations of the back right leg that is floating when a washing machine is in a dynamically imbalanced position, according to one embodiment of the present disclosure.

FIG. 6 is a diagram illustrating an example of a pattern of changes in displacement ratio according to position of a vibration sensor when a washing machine is in a dynamically imbalanced position, according to one embodiment of the present disclosure.

FIG. 7 is a diagram illustrating an example of a decision tree used to determine whether a washing machine is balanced, according to one embodiment of the present disclosure.

FIG. 8 is a diagram illustrating an example of a distribution of vibration data (displacement ratio) when a washing machine is in a dynamically balanced position, according to one embodiment of the present disclosure.

FIG. 9 is a diagram illustrating an example of a relationship between a state in which a washing machine is balanced and a displacement magnitude, according to one embodiment of the present disclosure.

FIG. 10 is a diagram illustrating an example of a result of detection of whether a washing machine is balanced by applying a deep neural network (DNN) to a washing machine according to one embodiment of the present disclosure.

FIG. 11 is a diagram illustrating an example of the dehydration speed and the profile of an acceleration period of the dehydration cycle of a washing machine according to one embodiment of the present disclosure.

FIG. 12 is a diagram illustrating an example of training data used for machine learning in a washing machine according to one embodiment of the present disclosure.

FIG. 13 is a diagram illustrating the configuration of a deep learning module for detection of whether a washing machine is in a dynamically balanced position.

FIG. 14 is a diagram illustrating a confusion matrix of actual frequency and predicted frequency of dynamic imbalance of a washing machine according to one embodiment of the present disclosure.

FIG. 15 is a flowchart of a method of detecting dynamic balance of a washing machine, the method being performed by a dynamic imbalance detection system according to one embodiment of the present disclosure.

FIG. 16 is a flowchart of a method of detecting dynamic imbalance of a washing machine, performed by a dynamic imbalance detection system according to one embodiment of the present disclosure.

FIG. 17 is a diagram illustrating a method in which a dynamic imbalance detection system for a washing machine according to one embodiment of the present disclosure notifies a user that a washing machine is in a dynamically imbalanced position.

DETAILED DESCRIPTION

The advantages and features of the present disclosure and method for achieving them will become apparent from the descriptions of aspects herein below with reference to the accompanying drawings. However, the present disclosure is not limited to the aspects disclosed herein but may be implemented in various different forms. Therefore, it should be noted that the present disclosure is intended to cover not only the aspects disclosed herein but also various alternatives, modifications, equivalents, and other embodiments that may fall within the spirit and scope of the embodiments as defined by the appended claims. The aspects disclosed herein are provided to make the description of the present disclosure thorough and to fully convey the scope of the present disclosure to those skilled in the art. In relation to describing the present disclosure, when the detailed description of the relevant known technology is determined to unnecessarily obscure the gist of the present disclosure, the detailed description may be omitted.

The terminology used herein is for the purpose of describing particular embodiments only and is not intended to be limiting. As used herein, the singular forms "a", "an" and "the" are intended to include the plural forms as well unless the context clearly indicates otherwise. It will be further understood that the terms "comprises", "includes", or "has" when used in this specification specify the presence of stated features, regions, integers, steps, operations, elements and/or components, but do not preclude the presence or addition of one or more other features, regions, integers, steps, operations, elements, components and/or combinations thereof. Terms used in the specification, "first", "second", etc., may be used to describe various components, but the components are not to be construed as being limited to the terms. That is, the terms are used to distinguish one component from another component.

In describing the present disclosure, the name of each component is defined taking into account the function thereof in the present disclosure. Therefore, the name of each component herein should not be construed as a limiting to the technical components of the present disclosure. The components of the present disclosure defined herein may be referred to as different names, respectively, by those skilled in the art.

Herein after, a washing machine 100 according to one embodiment of the present disclosure will be described in detail with reference to the accompanying drawings.

1. Operating Environment for Washing Machine and Dynamic Imbalance Detection System FIG. 3 is an example of an operating environment for a dynamic imbalance detection system according to one embodiment of the present disclosure. The detection system includes a washing machine 100 of a laundry system, a user terminal, an output device, and a network which connects the washing machine 100, the user terminal, and the output device. The washing machine 100 or the detection system detects the dynamic imbalance of the washing machine 100 using big data, an artificial intelligence (AI) algorithm, or a machine learning algorithm in a 5G-network environment built for implementation of the Internet of Things (IoT).

Referring to FIG. 3, the operating environment 1 for the laundry system includes a washing machine 100, a server 200, a user terminal 300, an output device 400, and a network 500. Examples of the output device 400 include AI speakers, AI TVs, and communication devices. The washing machine 100 is equipped with a communication unit and may transmit data obtained by a vibration sensor 110 to the server 200 via the communication unit over the wired or wireless network 500. The server 200 transmits information on the dynamic imbalance of the washing machine and various information on a wash cycle to the washing machine 100, the user terminal 300, and the output device 400 such an AI speaker.

The washing machine 100 includes a communication unit, an input unit, a sensing unit including a vibration sensor 110, an output unit including a display device, a memory unit including a memory, a power supply unit, a washing unit including physical parts for laundry such as a drum, and a controller including a micro controller unit (MCU).

The sensing unit of the washing machine 100 includes multiple sensors that detect various parameters required to control a washing process. Unless otherwise stated in the description of the present disclosure, the sensor of the sensing unit refers to the vibration sensor 110 that detects vibration of the washing machine 100.

The washing machine 100 according to one embodiment of the present disclosure includes the vibration sensor 110 and the controller. The vibration sensor 110 is attached to the cabinet of the washing machine 100 at a position which is spaced, by a predetermined distance, from a specific vibration axis that connects two legs in contact with the floor during the operation of the washing machine 100. The controller receives a vibration signal from the vibration sensor 110 during the operation of the washing machine 100 and transforms the vibration signal into vibration data. The vibration data and operation data measured in the washing machine 100 is transmitted to the server.

The controller of the washing machine or the server can process the vibration data and determines that the washing machine is in a dynamically imbalanced position, in a dynamically balanced state in which two legs other than the two legs forming the vibration axis vibrate to alternatively contact the floor and float from the floor, when a gap between the floor and a floating leg of the two vibrating legs is outside a predetermined range. The controller of the washing machine or the server determines whether the washing machine is in a dynamically imbalanced position based on at least one factor of three factors: i) a displacement magnitude of the vibration sensor 110 (see FIG. 9), which is determined from the vibration signal detected by the vibration sensor 110 during the operation of the washing machine, ii) a displacement ratio (see FIGS. 6 and 8) which is a ratio of a vertical component to a horizontal component of the displacement; or iii) a displacement phase that represents an angle between the direction of the displacement and the horizontal plane including the vibration axis parallel to the floor. The server diagnoses whether the washing machine is balanced based on the information transmitted from the vibration sensor, records the results of diagnosis, and transmits the results of diagnosis to a customer. The controller of the washing machine or the server determines whether the washing machine is in a dynamically imbalanced position through a test operation of the washing machine when the washing machine 100 is used for the first time after being installed or relocated. When the washing machine is not in a dynamically imbalanced position, the controller or the server notifies the user of detection of the dynamic out-of-level via a display panel of the washing machine or a smartphone application or makes a request for balancing of the washing machine to the user.

Examples of the controller of the washing machine include all kinds of devices capable of processing data such as a processor or a micro control unit (MCU). The controller of the washing machine is configured to receive one or more pieces of vibration data including a displacement magnitude, a displacement ratio, and a displacement phase from the vibration sensor 110 and to determine whether the washing machine is in a dynamically imbalanced position. The "processor" refers to a data processing device incorporated into a hardware device and having a physically configured circuit to perform functions expressed in the form of code or instructions included in a program. Examples of the data processing device implemented by hardware include processing devices such as microprocessors, central processing units (CPUs), processor cores, multiprocessors, application-specific integrated circuits (ASICs), and field programmable gate arrays (FPGAs), but the scope of the present invention is not limited thereto.

In the present embodiment, the washing machine 100 may perform machine learning such as deep learning in connection with searching for output devices 400, selecting a specific output device from among the detected output devices 400, and adjusting the volume of an audio signal output by the selected output device. The memory unit stores data including the data to be used for machine learning and data of the results.

On the other hand, the washing machine 100 and the server 200 may be equipped with an artificial neural network. Thus, the washing machine 100 or the server 200 may perform machine learning-based output device detection and output signal adjustment. That is, the washing machine 100 or the server searches for one or more output devices 400 that are present within the same space as the washing machine 100 and which outputs an audio signal or a video signal, select one of the detected output devices 400 according to operation mode, and adjusts the output signal to be output by the selected output device, based on machine learning. In addition, the washing machine 100 can perform machine learning-based output device selection and output signal transmission, thereby selecting at least one of the detected output devices 400 according to operation mode and transmitting an audio signal, a video signal, or both to the selected output device 400.

The communication unit of the washing machine provides communication interfaces required for transmission and reception of signals in the form of packet data exchanged among the output device 400, the user terminal 300 or the server 400. In addition, the communications unit 110 can support various machine-to-machine communications such as Internet of Things (IoT), Internet of Everything (IoE), Internet of Small Things (IoST), machine to machine (M2M) communication, vehicle to everything (V2X) communication, and device to device (D2D) communication.

In the present embodiment, examples of the user terminals 300 include desktop computers, smartphones, notebooks, tablet PCs, smart TVs, mobile phones, personal digital assistants (PDAs), laptop computers, media players, micro-servers, global positioning system (GPS) devices, e-book terminals, digital broadcasting terminals, navigations, kiosks, MP3 players, digital cameras, home appliances, and other mobile or stationary computing devices. The user terminal 300 may be a wearable device equipped with a communication function and a data processing function such as a watch, glasses, a hair band, and a ring. The user terminal 300 is not limited to the examples described above, and any device with a web browsing function may be used as the user terminal 300. Optionally, the user terminal 300 may serve as one of the output devices 400.

The server 200 may be a database server that provides big data for use in various artificial intelligence algorithms and data required for operation of the washing machine 100. Alternatively, the server 200 may be a web server or an application server that enables remote control of the operation of the washing machine 100 using a washing machine operating application program or a washing machine operating web browser executed in the user terminal 300.

Artificial intelligence (AI) is a field of computer science and information technology researching methods to make computers imitate intelligent human behaviors such as reasoning, learning, and self-development.

In addition, artificial intelligence (AI) does not exist on its own, but is rather directly or indirectly connected with other fields in computer science. In recent years, there have been extensive attempts to use artificial intelligence for problem solving in the field of information technology.

Machine learning is an application of AI that gives computers the ability to automatically learn and improve from experience without explicit programs. Specifically, machine learning is a technology to develop systems and algorithms that can generate a training dataset or a test dataset from empirical data, automatically learn from the generated datasets to determine a trained model, make predictions using the trained model, and enhance their own performance. Machine learning algorithms build a specific model to derive predictions or to make decisions based on input data, rather than executing strict static program instructions.

The server 200 is configured to receive, from the washing machine 100, the results of detection of one or more output devices 400 in operation and the operation mode of the washing machine 100 and transmit a control signal for controlling the output signals of the detected output devices 400 to the washing machine 100 according to the operation mode. Alternatively, the server 200 may receive the operation mode of the washing machine 100 from the washing machine 100, send the result of selection of at least one output device 400 from among the detected output devices 400 to the washing machine 100, and control the washing machine 100 to transmit an audio signal, a video signal, or both to the selected output device 100.

The network 500 connects the washing machine 100, the output device 400, the user terminal 300, and the server 200. As the network 500, various types of networks including cable networks such as local area networks (LANs), wide area networks (WANS), metropolitan area networks (MANs), and integrated service digital networks (iDNS) and wireless networks such as wireless LANs, CDMA, Bluetooth, and satellite communications networks can be used. But, the scope of the present invention is not limited thereto. The network 500 may use a short-range communications scheme or a long-range communications scheme. The long range communications schemes include Bluetooth, radio frequency identification (RFID), infrared data association (IrDA), ultra-wideband (UWB), ZigBee, and wireless fidelity (Wi-Fi), and the short range communications schemes include code division multiple access (CDMA), frequency division multiple access (FDMA), time division multiple access (TDMA), orthogonal frequency division multiple access (OFDMA), single carrier frequency division multiple access (SC-FDMA).

The network 500 includes connectors for connecting network elements, for example, hubs, bridges, routers, switches, and gateways. The network 500 supports multiple network interfaces. Thus, the network 500 includes public networks such as Internet and private networks such as secure corporate intranets. Access to the network 500 can be made via Ethernet cables or wireless access points. The network 500 supports 5G communications and IoT which is an extension of Internet connectivity to physical devices and everyday objects.

2. Vibration of Dynamically Imbalanced Washing Machine

FIG. 4 is a diagram illustrating the magnitude and direction of vibrations that occur when a washing machine is in a dynamically imbalanced position. The vibration sensor 110 is an acceleration sensor, a speed sensor, a displacement sensor, a gyro sensor, or a gravity sensor. One of these sensors may be selected depending on the specifications of the sensor required for detection of a dynamic imbalance during the operation of the washing machine 100. The vibration sensor 110 is preferably integrated into the main PCB. The vibration sensor 110 may be integrated into the controller that controls the overall operation of the washing machine 100. The controller and the vibration sensor 110 may be attached to a specific position of the washing machine cabinet. This enables estimation of the displacement of the cabinet vibrations that occur when the washing machine 100 is operated.

In FIG. 4, it is assumed that the vibration of the washing machine 100 is a rigid body vibration, there is no vibration of the floor beneath the washing machine 100, there is no deformation of the legs, and the legs are in point contact with the floor. Additionally, it is assumed that there is only motion of a rotation axis operation when calculating the displacement of the vibration sensor.

The vibration sensor 110 may be mounted at one of the top corners or at a position on the upper edges of the cabinet. As illustrated in FIG. 4, assuming that the washing machine 100 is 660 mm wide and 660 mm long and that a vibration axis diagonally extends from the front left (FL) corner to the back right (BR) corner, the vibration sensor 110 may be positioned at a certain point on a 1320 mm-long path which means a first 660 mm-long upper edge ranging from the front left (FL) corner to the back left (BL) corner and a second 660 mm-long upper edge ranging from the BL corner to the BR corner. Herein, the position at which the vibration sensor 110 can be mounted is defined as $\alpha$-coordinate. FIG. 4 illustrates an example of the mounting position of the vibration sensor. For example, the vibration sensor is mounted on the upper edge of the cabinet, specifically at a point in the vicinity of the BL corner. With reference to the $\alpha$-coordinate at which the vibration sensor 110 is located, a gap $\beta$ between the floor and a washing machine leg that is floating due to the cabinet vibration which occurs on either side of the diagonal vibration axis is determined. As illustrated in FIG. 2, noise caused by vibration of the washing machine 100 increases with the gap $\beta$ of the washing machine leg from the floor. In order to measure the magnitude and phase of the displacement of the vibration sensor 110, attributable to vibration of the washing machine 100, an XYZ coordinate system is set such that the position at which the vibration sensor 110 is located is defined as the origin, the widthwise direction of the washing machine 110 is defined as X-axis, the lengthwise direction orthogonal to the widthwise direction (X-axis) is defined as Y-axis, and the height direction of the washing machine, which is perpendicular to the XY plane, is defined as Z-axis.

FIG. 2 is a graph illustrating the results of noise measurement with the length of the back right (BR) being varied. Referring to FIG. 2, when the length of the back right (BR) leg is adjusted by −¾ mm (decreased by ¾ mm) from the default length, the BR leg is floating, thereby generating a maximum level of noise (see a portion denoted by reference number 101 in FIG. 2). When the length of the BR leg is adjusted by +4/4 mm (increased by 4/4 mm) from the default length, the back left (BL) leg is floating, thereby generating a maximum level of noise (see a portion denoted by reference number 102 in FIG. 2). Knowing the gap $\beta$ between the floating leg and the floor, it is possible to predict the degree of dynamic imbalance and the level of noise.

When the BL leg is floating as shown in a left image of FIG. 4, the center of gravity of the washing machine 100 shifts forward. Thus, the two front legs and the BR leg come into contact with the floor. When the center of gravity shifts backward, the opposite inclination occurs. When the laundry load in the drum becomes unbalanced after the rotation of the washing machine 100 is started, the washing machine cabinet will start vibrating. In this case, two diagonal legs of the four legs of the washing machine perform seesaw motion about the diagonal vibration axis that diagonally connects the other two legs. Depending on the position (BL or BR) of the washing machine leg that is floating, the direction of the vibration of the vibration sensor 110 changes. In addition, depending on the gap of the washing machine leg from the floor, the magnitude of the vibration of the vibration sensor 110 changes. Therefore, it is possible to determine which leg is floating based on such information.

The mounting position of the vibration sensor 110 is determined on the principle that the displacement of the sensor 110 increases with a distance r from the rotation axis (vibration axis) and the mounting position of the vibration sensor 110. That is, it is preferable that the vibration sensor 110 is positioned at the upper edge of the washing machine cabinet rather than being positioned at the lower edge. As the distance r between the rotation axis and the mounting position of the vibration sensor 110 is increased, it is easier to sense the displacement of the vibration sensor 110. When the vibration sensor 110 is installed at the lower edge of the washing machine 100, it is necessary to use a higher sensitivity sensor in order to accurately and precisely detect a smaller magnitude of vibration.

The vibration sensor 110 can detect, for example, a displacement magnitude, a displacement ratio which is a ratio of a vertical component (top-to-bottom displacement) to a horizontal component (side-to-side displacement) of a displacement, and a displacement phase which is an angle between the direction of the displacement and the horizontal plane on which a vibration axis parallel to the floor lies. According to one example of the present disclosure, the vibration sensor 110 is preferably installed at a position on the vibration axis 120 or 130, a position on the upper edges of the washing machine cabinet, or one of the top corners of the washing machine cabinet. The controller of the washing machine or the server determines whether the washing machine is in a dynamically imbalanced position based on the phase of a displacement when the vibration sensor 110 is installed at the middle of one upper edge of the washing machine cabinet. On the other hand, when the vibration sensor 110 is installed at one of the top corners of the washing machine cabinet, the controller or the server determines whether the washing machine is in a dynamically imbalanced position based on the displacement ratio.

3. Principle of Detection of Dynamic Level

FIG. 5A is a diagram illustrating an example of a pattern of axial vibrations of a washing machine cabinet when the dynamic imbalance of the washing machine 100 occurs with the back left (BL) leg floating, according to one embodiment of the present disclosure. FIG. 5B is an example of a pattern of axial vibrations of a washing machine cabinet when the dynamic imbalance occurs with the back right (BR) leg floating, according to one embodiment of the present disclosure. FIG. 5A and FIG. 5B illustrate a case where the direction of vibration is detected based on the phase of a displacement.

When the back left (BL) leg is floating as illustrated in FIG. 4, the vibration sensor 110 is displaced in (+, +, +) and (−, −, −) directions as illustrated in FIG. 5A. On the other hand, when the back right (BR) leg is floating, the vibration sensor 110 is displaced in (−, +, +) and (+, −, −) directions as illustrated in FIG. 5B. FIG. 5A indicates that an X-axis displacement 140, a Y-axis displacement 141, and a Z-axis displacement 142 occur in the same direction, thereby having no phase difference among the displacements when the BL leg is floating. FIG. 5B indicates that the X-axis displacement 140 has a phase difference of 180° from each of the Y-axis displacement 141 and the Z-axis displacement 142 when the BL leg is floating. Therefore, it is possible to determine which leg is floating based on the phases of the displacements and the inner product of the displacements of the respective axes. When the washing machine is in a dynamically balanced position, it has an intermediate phase.

FIG. 6 is a diagram illustrating an example of a pattern of changes in displacement ratio according to position of the vibration sensor when the washing machine is in a dynamically imbalanced position. FIG. 6 illustrates a case of detecting the direction of vibration based on the displacement ratio.

Depending on to which axis among the X-axis, Y-axis, and Z-axis the direction of vibration is inclined (depending on the direction of vibration), the displacement ratio for each axis varies. Using these characteristics, it is possible to detect the direction in which the leg is floating. When the washing machine is perfectly balanced (in a perfectly dynamically balanced position), since the displacement in the vertical direction is nearly zero, the displacement ratio also becomes zero. Referring to FIG. 6, when the vibration sensor 110 vibrates around the rotation axis 120 that passes the front left (FL) leg and the back right (BR) leg, when the back left (BL) leg is floating, a displacement ratio curve 152 shows that the displacement ratio is maximal (0.5 or more) at an α-coordinate of 660 mm (BL corner) and is minimal (zero) at an α-coordinates of 0 mm and 1320 mm (BR corner). Conversely, when the vibration sensor 110 vibrates around the rotation axis 130, when the back right (BR) leg is floating, a displacement ratio curve 151 shows that the displacement ratio is maximal (0.5 or more) at α-coordinates of 0 mm 1320 mm and is minimal (zero) at an α-coordinate of 600 mm (BL corner). In this way, the displacement ratio varies depending on the direction of the vibration. As illustrated in FIG. 4, as to the vibration sensor 110 attached to the upper rear edge at a position near the back left (BL) corner, when the vibration sensor 10 is positioned at a measurement position 150 corresponding to an α-coordinate of 660 mm or larger, the displacement ratio of the case where the back left (BL) leg is floating is greater than the displacement ratio of the case where the back right (BR) leg is floating. Accordingly, when the displacement ratio of the position (α-coordinate) of the vibration sensor is obtained, it is possible to determine which leg is floating (the BL leg or the BR leg), the direction of vibration, and the magnitude of vibration.

On the other hand, as illustrated in FIG. 6, when the vibration sensor 110 is at the middle of the upper rear edge, since the displacement ratio of the case where the BL leg is floating and the displacement ratio of the case where the BR leg is floating are theoretically equal, which leg is floating cannot be determined based on the displacement ratio but can be determined based on the displacement phase. Therefore, it is preferable to place the vibration sensor 110 as close to a corner as possible when determining whether the washing machine is balanced based on the displacement ratios. On the other hand, when the vibration sensor 110 is positioned at one of the four top corners, since the magnitude of the vertical displacement is nearly zero, it is difficult to measure the phase for the vertical direction. Thus, it is preferable to determine whether the washing machine is balanced based on the displacement ratio. In general, since it is more difficult to detect the displacement phase, it is preferable to detect the displacement ratio.

FIG. 7 is a diagram illustrating an example of a decision tree for detection of whether a washing machine 100 according to one embodiment of the present disclosure is balanced. FIG. 7 is a decision tree in which three classes (BL leg floating, normal (balanced), and BR leg floating) are set according to the displacement ratios and five classes (−1.5, −1, normal (−0.5 to 0.5), 1, and 1.5) are set according to the displacement magnitudes. Referring to FIG. 7, it is possible to determine whether a washing machine is normally balanced or unbalanced, in which direction an imbalance error occurs (for example, BL floating or BR floating), and the degree of the imbalance error occur, based on the displacement ratio. In general, the magnitude of vibrations of the cabinet increases with a gap (floating) of a leg from the floor (See FIG. 9). From this perspective, it is possible to determine the degree of an imbalance error. To represent the degree of an out-of-level error, five classes (−1.5, −1, normal (−0.5 to 0.5), 1, and 1.5.) are set based on a combination of the displacement ratio and the displacement magnitude.

Specifically, it is possible to determine whether an out-of-level error occurs and in which direction the out-of-level error occurs based on the displacement ratio (BL floating (0.444>displacement ratio>0.0657); normal (0.0657>displacement ratio); and BR floating (displacement ratio>0.444). In addition, it is possible to determine how high the leg is raised from the floor based on the displacement magnitude and the displacement ratio (for example, −1.5, −1, 1, and 1.5). Referring to FIG. 7, after determining that the BL leg is floating based on the displacement ratio (i.e., 0.444>displacement ratio>0.0657), the floating degree (−1.5 and −1) of the BL leg from the floor is determined based on the displacement magnitude (i.e., displacement magnitude>0.440). Similarly, after determining that the BR leg is floating based on the displacement ratio (i.e., displacement ratio>0.444), the floating degree (1.5 and 1) of the BR leg from the floor is determined based on the displacement magnitude (i.e., displacement magnitude>0.910).

4. Learning based on Machine Learning Algorithm and Big Data

The displacement ratio and the displacement magnitude used in the decision tree of FIG. 7 can be obtained from actual values and predicted values of FIGS. 8 to 10 through experiments based on deep learning.

The device or server for detecting a dynamic out-of-level error according to one embodiment of the present disclosure can determine whether the washing machine 100 is in a dynamically imbalanced position using big data and machine learning. The device or server for detecting a dynamic imbalance error includes a memory unit in which vibration data transformed from a vibration signal detected by the vibration sensor is recorded. The washing machine controller or the server generates a training dataset by collecting at least one feature selected from a group of a displacement magnitude, a displacement ratio, and a displacement phase and a determination result value (dynamically balanced or dynamically imbalanced) labeled with the selected feature after making a determination on whether a washing machine is balanced unbalanced for each time of operation of the washing machine, determines a trained detection model by training a machine learning algorithm on the training dataset, and determines whether the washing machine is in a dynamic out-of-position by applying the trained detection model to vibration data received after the trained detection model is determined.

According to another embodiment of the present disclosure, the washing machine controller or the server operates the washing machine 100 after determining whether the washing machine is in a dynamically imbalanced position using the trained detection model to collect additional vibration data, generates a retrained detection model by training the trained detection model on the additional vibration data in the server, operates the washing machine again to collect additional vibration data after the retrained detection model is generated, and determines whether the washing machine is in a dynamically imbalanced position by using the retrained detection model. The washing machine controller or the server repeatedly collects vibration data after making the determination using the trained detection model, and retrains the trained detection model through machine learning, thereby obtaining a detection model having an improved performance.

According to a further embodiment of the present disclosure, the server performs: collecting and accumulating at least one feature selected from a group of a displacement magnitude, a displacement ratio, and a displacement phase and a determination result value (dynamically balanced or dynamically imbalanced) labeled with the one or more features, with respect to one or more washing machines that are the same kind as a washing machine 100 to be inspected; generating a training dataset from the one or more features and the determination result values labeled with the features; training a machine learning algorithm on the training dataset to determine a trained detection model; and determining whether the washing machine 100 to be inspected is in a dynamically imbalanced position by applying the trained detection model which is trained with vibration data of the same kind of washing machines as the to-be-inspected washing machine. When the to-be-inspected washing machine 100 is a new washing machine that has not been used after installation, since the server has no vibration data collected from the to-be-inspected washing machine 100, the server uses a machine learning algorithm that is trained on vibration data collected from other washing machines that are the same kind as the to-be-inspected washing machine 100 to determine whether the to-be-inspected washing machine 100 is in a dynamically imbalanced position.

FIG. 8 is a diagram illustrating an example of a distribution of vibration data (displacement ratio) under dynamic conditions of a washing machine 100 according to one embodiment of the present disclosure. FIG. 8 illustrates the results of training of a model using a deep learning structure including an input layer in which inputs are displacement ratios and output layers in which outputs are −1.5, −1.0, 0.5, 0.0, 0.5, and 1.0. Referring to the decision tree shown in FIG. 7, the displacement ratios are divided into three classes that respectively represent normal (perfectly balanced), BR floating, and BL floating. Division lines for distinguishing the classes are shown in FIG. 8. The boundary displacement ratio for distinguishing between the normal and the BR floating is 0.0657 and the boundary displacement ratio for distinguishing between the BL floating and the BR floating is 0.444. In FIG. 8, there are three areas demarcated by a dotted line. Among them, the lowest one is referred to as a normal region including displacement ratios that are approximately 0.0 and representing a state in which a washing machine is balanced and no back legs are not floating, the middle one is referred to as a BR floating region including displacement ratios in a range of 0.09657 to 0.444 and representing a state in which a washing machine is unbalanced and the BR leg is floating, and the uppermost one is referred to as a BL floating region including displacement ratios greater than 0.444 and representing a state in which a washing machine is unbalanced and the BL leg is floating. Each of the marks "X" present outside the dotted-line areas represents a displacement ratio that is erroneously classified by a DNN learning model.

FIG. 9 is a diagram illustrating a correlation between displacement magnitudes and horizontal states (normal, BR floating, and BL floating) of a washing machine 100 according to one embodiment of the present disclosure. FIG. 9 illustrates the training results of a model that is trained by a deep learning structure including an input layer in which inputs are displacement magnitudes and five output layers in which outputs are −1.5, −1.0, −0.5, 0.0, 0.5, 1.0, 1.5. In FIG. 9, a left dotted-line area represents BL floating, a right dotted-line area represents BR floating, a division line represents a displacement magnitude of 0.444 for distinguishing between a labeled class of −1.5 and a labeled class of −1.0, and a division line represents a displacement magnitude of 0.910 for distinguishing between a labeled class of 1 and a labeled class of 1.5.

FIG. 10 is a diagram illustrating an example of a result of detection of whether a washing machine is balanced by applying a deep neural network (DNN) to a washing machine according to one embodiment of the present disclosure. FIG. 10 is a horizontal state detection result using the five classes (−1.5, −1.0, −0.5, 0.0, 0.5, 1.0, 1.5) of the deep learning structure of FIG. 9. The 5-class predictions results (−1.5, −1.0, −0.5, 0.0, 0.5, 1.0, 1.5) of the DNN according to the five classes (−1.5, −1.0, −0.5, 0.0, 0.5, 1.0, 1.5) have a small error for each class.

The reason for the errors in the DNN application of FIGS. 8 and 10 is because the vibrations of the tub and cabinet of the washing machine become more violent as the load in the drum of the washing machine 100 is more severely unbalanced and because the magnitude and characteristics of the vibration of the washing machine 100 vary for each wash cycle according to the type and quantity of laundry and the degree of distribution of laundry in the drum.

FIG. 9 shows how the vibration data changes as the dynamic horizontal state of the washing machine 100 actually changes. As seen from the prediction results of FIG. 8, the BL floating results in a vibration displacement ratio of about 0.5, and the BR floating results in a vibration displacement ratio of about 0.2. When the dynamic horizontal state is close to perfect horizontality, the vertical component is approximately zero, and the displacement ratio is also zero. In actual use, there is a certain amount of dispersion depending on the type, quantity, and distribution of laundry. When this is reflected, a better detection result can be obtained.

However, there are also outliers which are difficult to classify, resulting in a poor dispersion of distribution. The reason that there are the outliers is that even though a leg or legs are floating, when load is well balanced or is just slightly unbalanced, the vibration of the washing machine 100 is not so strong. In this case, since the magnitude of vertical vibration is nearly zero, it is difficult to distinguish between this state and the dynamic horizontal state. On the other hand, even though the dynamic horizontal state is close to perfect horizontality, when load is severely unbalanced, vertical vibration will be greatly increased. In this case, it is difficult to distinguish between the BL floating and the BR floating.

To compensate for this, there are three approaches: 1) precisely detecting unbalanced load in the drum and using this detection result to diagnose a horizontal state, 2) storing and accumulating data of multiple operations on the server to increase accuracy, and 3) using vibration data (magnitude, displacement ratio, phase, etc.) at various speeds as input.

FIG. 11 is a diagram illustrating an example of the dehydration speed and the profile of an acceleration period of a washing machine according to one embodiment of the present disclosure. During the dehydration cycle of the washing machine 100, the drum starts rotating slowly at an early stage and then rotates faster to reach its maximum speed. As described above, when detecting a horizontal state based on a displacement magnitude and a displacement ratio, vibration will vary depending on the rotation speed of the drum even with the same washing machine or with the same load distribution. Referring to FIG. 11, a displacement magnitude and a displacement ratio are predicted first and then a rotation speed (rpm) is determined at which it is easy to determine a horizontal state. Through this method, it is possible to improve the accuracy of detection of a dynamic imbalance.

FIG. 12 is a diagram illustrating an example of training data for use in a machine learning process of a washing machine 100 according to one embodiment of the present disclosure. Actual vibration data is likely to include abnormal values (outliers) or contaminated values that deteriorate the quality of a dataset. Training data is not free from data quality issues, for example, incompleteness (having no attributes, or missing values), much noise (incorrect records or outliers), and inconsistencies (there are conflicting records or inconsistent values). Therefore, the data is pre-processed to improve the performance of machine learning and an artificial neural network model. FIG. 12 is a graph in which the importance of each of the features used as training data is represented by an F-score to determine which rpm is more advantageous for detection of a horizontal state of a washing machine. Referring to FIG. 12, it is possible to obtain better performance by using the features 470_Dy, 3402_Dy, 600_ratio, 470_ratio, 3402_Dz that are higher in feature importance. Therefore, it is possible to improve detection performance by selecting important data through pre-processing of the vibration data.

FIG. 13 is a diagram illustrating a deep learning structure for detecting a dynamic horizontal state. FIG. 13 shows the results of training a detection model using a deep learning structure. The results show that the validation accuracy is 0.95. The deep learning structure includes: input layers corresponding to five features 470_Dy, 3402_Dy, 600_ratio, 470_ratio, and 3402_Dz having higher F-scores representing feature importance as illustrated in FIG. 12; output layers of BL floating (1 mm), normal (0), and BR floating (1 mm); and six hidden layers. This shows that 95% validation accuracy is obtained when using the features having higher F-scores.

Pre-processing the dataset before training a neural network model with training dataset results in higher detection performance. When training a neural network model by selecting principle factors through the K-select method, it is possible to obtain 5% to 10% higher detection performance compared to the existing decision tree, as illustrated in FIG. 13. Performance improvement can also be achieved by using other machine learning technologies such as SVM.

FIG. 14 is a diagram illustrating a confusion matrix of actual values and predicted values for a washing machine according to one embodiment of the present disclosure. FIG. 14 illustrates an embodiment in which a detection result of an imbalance is notified to a customer when the reliability of prediction is a specific value (for example, 99.9% or 98.5%) or higher by applying the Naive Bayesian Classification to cumulative vibration data. The Naive Bayesian Classification is a method of performing predictions and estimating the accuracy of predictions using conditional probabilities. Referring to the confusion matrix of FIG. 14, the precision of the BL floating is 100%, the precision of the horizontal state is 93%, and the precision of the BR floating is 98% from a total of 159 tests performed. Considering the precision of the BR floating, the Naive Bayesian Classification can be used to increase the reliability of prediction of detection of dynamic horizontal state when the washing machine 100 is operated multiple times.

When 150 tests are performed, predicted frequency (the number of occurrences) of the BR floating is 47, and actual frequency of the BR floating is 46. In this case, the probability of the BR floating is 46/47=97.8%, the probability of normal (horizontal state) is 1/47(%), and the probability of the BL floating is 0%. Therefore, the BR floating having the highest probability is determined as the result of the determination of the horizontal state. The probability that the prediction is correct is 97.8%. However, since the probability is lower than a criterion of 99.9% for giving a user a notification, notification is not performed in this case.

Assuming that the horizontal state has not changed, when the washing machine is operated one more time and the prediction result for this operation is the BR floating (that is, the prediction is the BR floating and the actual case is the BR floating), the conditional probability of the BR floating is calculated such that the actual probability of the BR floating is 46/51*46/51/(1/65*1/65+46/51*46/51)=99.97%. Therefore, since the criterion of 99.9% is satisfied, a notification to the user is performed.

The accuracy increases with the number of data entries, but there is a problem of a late detection of a malfunction as the number of data entries is increased. When the prediction accuracy is approximately 90% or more, when data corresponding to 3 to 4 times of operation is accumulated, a prediction with a probability of 99.9% is possible. This corresponds to a case where one erroneous prediction occurs when the machine is operated about 100 times a year. Therefore, it is preferable to perform a notification when 3 to 4 data entries are accumulated.

FIG. 15 is a flowchart of a method of detecting a dynamic horizontal state, which is implemented by a washing machine 100 or a dynamic imbalance detection system according to one embodiment of the present disclosure. In the following description, a redundant description associated with FIGS. 1 through 14 will be omitted.

Referring to FIG. 15, when a washing machine 100 starts operating in step S610, a vibration sensor 110 attached to the cabinet of the washing machine 100 detects vibration in step S620. Specifically, the vibration sensor 110 is mounted at a position spaced from a specific vibration axis that connects two legs among the legs that are in contact with the floor when the washing machine 100 is in operation.

In step S630, a controller receives a vibration signal detected by the vibration sensor 110 during the operation of the washing machine 100 and processes it into vibration data. According to one embodiment of the present disclosure, the vibration data resulting from the processing of the vibration signal is one or more features including a displacement size, a displacement ratio, and a displacement phase.

In step S640, the controller or a server that receives the vibration data from the controller performs processing on the vibration data and determines that the washing machine is in a dynamically imbalanced position when the remaining two legs other than the two legs that are in contact with the floor and are on the vibration axis perform seesaw motion to alternately float and contact the floor and the gap between the floating leg and the floor is outside a predetermined range.

In step S650, the controller or the server stores the results of each step of determining whether the washing machine is balanced under dynamic conditions, and then notifies the user of the results of the determination or makes a request for balancing the washing machine 100 to the user in step S660. The method of determining the dynamically imbalanced position is performed during a test operation when the washing machine 100 is first used after installation.

FIG. 16 is a flowchart of a method of detecting whether a washing machine is out of level under dynamic conditions, according to one embodiment of the present disclosure. In the following description, a redundant description associated with FIGS. 1 through 15 will be omitted.

According to one embodiment of the present disclosure, the step S640 of determining whether the washing machine 100 is in a dynamically imbalanced position includes steps S641 through S648, that is, a method of detecting dynamic imbalance through machine learning.

In step S641, the controller or the server collects at least one feature selected from a group of a displacement size, a displacement ratio, and a displacement phase and the determination results (either of balanced and imbalanced) labeled with the features by operating the washing machine 100 multiple times.

In step S642, the controller or the server generates a training dataset or a test data set to be used in a machine learning algorithm. The test dataset is a portion of the training dataset. Therefore, it is possible that a training dataset is prepared first and later a portion of the training dataset is designated as a test dataset. Because the quality of data to be used for learning is important, the dynamic imbalance detection performance is improved by pre-processing the data before starting a deep learning structure.

In step S643, the control or the server stores the training dataset and the test dataset in a memory unit.

In step S644, the control or the server let a learning machine to learn the training dataset using the machine learning algorithm to generate a model.

In step S645, the controller or the server tests the model with the test dataset to determine a trained model.

In step S646, the trained model is used to determine a dynamic imbalance based on actual vibration data received.

According to another embodiment of the present disclosure, the step S640 of determining whether the washing machine 100 is in a dynamically imbalanced position can retrain the trained model.

Additionally collected data entries of the vibration data and operation data are used to retrain the dynamic imbalance detection algorithm. Therefore, in step S647, the controller or the server operates the washing machine 100 after determining the dynamic imbalance using the trained model to collect additional vibration data, and stores the added vibration data so as to be learned in the server, thereby generating a retrained model.

In phase S648, the controller or server operates the washing machine 100 again after generating the retrained model to obtain additional vibration data, and determines whether the washing machine is in a dynamically imbalanced position using the retrained model.

5. Service for Detecting, Diagnosing, and Notifying Balance, and Rebalancing

FIG. 17 is a diagram of an exemplary method of notifying a user of the results of determination on a dynamic imbalance of a washing machine 100 by a dynamic imbalance detection system according to one embodiment of the present disclosure.

The results of determination on a dynamic imbalance by the dynamic imbalance detection algorithm is used when the washing machine 100 is operated first time after it is installed or relocated or in everyday practical use of the washing machine 100. After installing the washing machine 100 at a location, operation of the washing machine is tested with a specified load (1 wet towel or rubberized UB). By using the vibration data of the test operation, whether the washing machine is balanced or not is diagnosed. Then, an installation service person is provided with the result of the diagnosis or with instructions to level the washing machine.

In addition, it is used to determine whether the washing machine 100 is balanced or unbalanced when the washing machine 100 is relocated or accidently moved due to walking during normal use of the washing machine. Vibration data of the washing machine 100 is transmitted to a ThinQ server via a communication network such as WiFi. A diagnostic server detects the horizontal state (i.e., balanced or unbalanced) of the individual washing machine 100 from this data. When the imbalance is detected, the diagnostic server notifies the customer of the status of improper balance using the display of the washing machine 100 or the ThinQ app which is an application provided by LG Electronics Co., Ltd. via a communication network such as Wi-Fi. The customer can make a request for after service by simply pushing an AS request button on the display or on the ThinQ app. In this case, a service person will visit the customer to rebalance the washing machine. When the customer wants to fix the problem on his own, instructions for rebalancing the washing machine are provided to the customer.

The embodiments of the present disclosure described above may be implemented in the form of a computer program that can be executed in a computer, and the computer program will be recorded on a computer-readable medium. The computer-readable media include magnetic media such as hard disks, floppy disks and magnetic tapes, optical recording media such as CD-ROMs and DVDs, magneto-optical media such as floptical disks, and hardware devices specifically configured to store and execute program instructions, such as ROM, RAM, and flash memory.

On the other hand, the computer program may be specifically designed and configured for implementation of the present disclosure, or may be publicly available to professionals in the field of computer software. Examples of computer programs may include machine language code, such as those created by compilers, as well as high-level language code that can be executed by a computer with an interpreter.

The embodiments of the present disclosure described above can also be applied to other products in which the legs vibrate due to the rotation of a motor, for example, other electronic and industrial products such as dryers.

The use of the term "the" and similar terms in the specification of the present disclosure (especially in the scope of the patent claim) may be both singular and plural. In addition, when a range is specified in the present disclosure, unless otherwise stated, the present disclosure covers inventions to which respective values within the range are applied. Thus, the detailed description of the present disclosure shall include cases where each individual value that constitutes the range is described.

The method steps, processes, and operations described herein are not to be construed as necessarily requiring their performance in the particular order discussed or illustrated, unless specifically identified as an order of performance. It is also to be understood that additional or alternative steps may be employed. The present invention is not limited to the order of steps, processes, and operations described herein. The use of all examples or exemplary terms (examples, etc.) in the present disclosure is simply to describe the present disclosure in detail and does not limit the scope of the present disclosure due to the above examples or exemplary terms, unless limited by the scope of the patent claim. In addition, those skilled in the art will appreciate that various modifications, combinations and changes can be made according to the design conditions and factors within the scope of the claims and equivalents thereto.

The present disclosure described as above is not limited by the aspects described herein and accompanying drawings. It should be apparent to those skilled in the art that various substitutions, changes and modifications which are not exemplified herein but are still within the spirit and scope of the present disclosure may be made. Therefore, the scope of the present disclosure is defined not by the detailed description, but by the claims and their equivalents, and all variations within the scope of the claims and their equivalents are to be construed as being included in the present disclosure.

What is claimed is:

1. A method of determining whether a washing machine is unbalanced under dynamic conditions, the method being implemented by a washing machine or a washing machine and a server communicating with the washing machine, the washing machine including a vibration sensor, four legs and a controller for processing a vibration signal transmitted from the vibration sensor, the method comprising:

a) starting a spin cycle of the washing machine;

b) detecting vibration, by the vibration sensor attached to a washing machine cabinet of the washing machine at a position spaced by a predetermined distance from a specific vibration axis that connects two legs among the four legs of the washing machine that are in contact with a floor during the spin cycle of the washing machine;

c) by the controller, receiving the vibration signal detected by the vibration sensor during the spin cycle of the washing machine and processing the vibration signal into vibration data; and d) by the controller or the server receiving the vibration data from the controller, in a vibration level state in which the remaining two legs of the four legs that vibrate about the vibration axis alternately vibrate, processing the vibration data and determining that the washing machine is unbalanced when a gap between the floor and a floating leg of the remaining two legs is outside a predetermined range, wherein determining that the washing machine is unbalanced in d) uses at least one of a displacement magnitude of the vibration sensor, a displacement ratio of a vertical component to a horizontal component of a displacement of the vibration sensor, or a displacement phase of an angle between a direction of the displacement of the vibration sensor and the horizontal plane including the vibration axis parallel to the floor, wherein determining that the washing machine is unbalanced in d) comprises:

by the controller or the server, generating a training dataset by collecting the at least one of the displacement magnitude, the displacement ratio, or the displacement phase;

determining result values of dynamic balance and dynamic imbalance labeled with the at least one of the displacement magnitude, the displacement ratio, or the displacement phase;

determining a model by training a machine learning algorithm on the training dataset to determine the dynamic imbalance; and determining whether the washing machine is in a dynamically imbalanced position by applying the trained model to vibration data received after determining the model, and wherein determining that the washing machine is unbalanced in d) comprises applying a deep learning structure in which the at least one of the displacement magnitude, the displacement ratio, or the displacement phase are input layers and a back left leg floating, a back right leg floating, and normal balancing are output layers.

2. The method according to claim 1, wherein determining that the washing machine is unbalanced in d) based on the displacement phase when the vibration sensor is positioned at a middle of an edge of the washing machine cabinet or based on the displacement ratio when the vibration sensor is positioned at one of four corners of the washing machine cabinet.

3. The method according to claim 1, further comprising:

e) by the controller or the server, storing results of the determining that the washing machine is unbalanced in d); and f) notifying a user of the dynamic imbalance via a panel portion of the washing machine or a smartphone application or requesting the user to rebalance the washing machine.

4. The method according to claim 3, wherein the machine learning algorithm uses a Naive Bayses Classification after operating the washing machine multiple times, and wherein notifying or requesting in f) is performed when a prediction reliability of the dynamic imbalance is a specific percentage value or more when applying the Naive Bayses Classification to the vibration data.

5. The method according to claim 1, wherein the training dataset on which the machine learning algorithm is to be trained is pre-processed to improve quality of the training dataset.

6. The method according to claim 1, wherein the d) determining of the dynamic imbalance comprises:

by the server, receiving and storing the at least one of the displacement magnitude, the displacement ratio, or the displacement phase measured from a comparative washing machine that is a same kind as the washing machine;

determining result values of dynamic balance and dynamic imbalance labeled with the at least one of the displacement magnitude, the displacement ratio, or the displacement phase from the comparative washing machine;

generating a training dataset from the at least one of the displacement magnitude, the displacement ratio, or the displacement phase from the comparative washing machine and the determined result values labeled with the at least one of the displacement magnitude, the displacement ratio, or the displacement phase from the comparative washing machine;

training a machine learning algorithm on the training dataset to determine the dynamic imbalance, thereby generating a trained model; and determining whether the washing machine is in a dynamically imbalanced position by applying the model trained on the same kind of comparative washing machine to the washing machine.

7. The method according to claim 1, wherein the method is performed through a test operation of the washing machine when the washing machine is used for a first time after being installed, the method further comprising at least one of:

notifying a user of the imbalance under dynamic conditions through a smartphone application or via a display panel of the washing machine;

providing the user with an instruction helping the user rebalance the washing machine; or requesting the user to rebalance the washing machine after determining the washing machine is unbalanced in d).

* * * * *